United States Patent [19]

Artzt et al.

[11] Patent Number: 4,700,431

[45] Date of Patent: Oct. 20, 1987

[54] PROCESS AND APPARATUS FOR ELIMINATING DUST FROM FIBER MATERIAL

[75] Inventors: Peter Artzt, Reutlingen; Heinz Muller, Metzingen-Neuhausen; Kurt Ziegler, Kirchheim-Nabern; Gerhard Egbers, Reutlingen, all of Fed. Rep. of Germany; Jacek Wokaun, Winterthur, Switzerland

[73] Assignee: Schubert & Salzer, Ingolstadt, Fed. Rep. of Germany

[21] Appl. No.: 763,345

[22] Filed: Aug. 7, 1985

[30] Foreign Application Priority Data

Aug. 7, 1984 [DE] Fed. Rep. of Germany ..... 3429024

[51] Int. Cl.[4] ..... D01G 15/40; D01H 7/882

[52] U.S. Cl. ..... 19/105; 57/411; 57/301

[58] Field of Search ..... 19/105, 97.5, 205; 57/301, 302, 400, 403, 408, 411, 412–416

[56] References Cited

U.S. PATENT DOCUMENTS

| | | | |
|---|---|---|---|
| 3,205,538 | 9/1965 | Miller . | |
| 3,728,853 | 4/1973 | Schiltknecht | 57/58.95 |
| 3,800,520 | 4/1974 | Schiltknecht | 57/411 |
| 3,834,145 | 9/1974 | Ellingham et al. | 57/411 X |
| 3,884,028 | 5/1975 | Stahlecker et al. | 57/301 |
| 3,953,961 | 5/1976 | Harrap et al. | 57/411 X |
| 3,975,895 | 8/1976 | Stahlecker | 57/301 X |
| 4,135,276 | 1/1979 | Handschuch et al. | 19/105 X |
| 4,201,037 | 5/1980 | Artzt et al. | 57/411 X |
| 4,470,172 | 9/1984 | Leifeld | 19/202 |
| 4,486,922 | 12/1984 | Toevank et al. | 19/200 |
| 4,499,633 | 2/1985 | Trutzschler | 19/105 |
| 4,499,718 | 2/1985 | Junek et al. | 57/411 X |

FOREIGN PATENT DOCUMENTS

| | | | |
|---|---|---|---|
| 2217394 | 12/1972 | Fed. Rep. of Germany . | |
| 2739517 | 11/1978 | Fed. Rep. of Germany . | |
| 1017042 | 11/1952 | France . | |
| 404686 | 1/1934 | United Kingdom . | |
| 1361986 | 7/1974 | United Kingdom . | |
| 2152957 | 8/1985 | United Kingdom | 57/400 |

*Primary Examiner*—Louis K. Rimrodt
*Assistant Examiner*—J. L. Olds
*Attorney, Agent, or Firm*—Dority & Manning

[57] ABSTRACT

Fiber material is conveyed over a sieve-like surface to remove dust from material. The fiber material is thereby exposed to a suction airstream which is guided through the sieve-like surface and which is guided away from the fiber material at an acute angle which is formed opposite to the fiber transport direction. The fiber material may be aligned in parallel before it is exposed to the suction airstream. In order to orient the suction airstream at the desired acute angle relative to the fiber transport direction, the fiber material is guided over sieve orifices which are inclined at the acute angle opposite to the fiber transport direction.

36 Claims, 6 Drawing Figures

34
63
630
34
60
600
61
610
64
640
62
620
641
69
6
690
650
65
661
662
66
660
67
670
671
671
68

PROCESS AND APPARATUS FOR ELIMINATING DUST FROM FIBER MATERIAL

BACKGROUND AND SUMMARY OF THE INVENTION

The present invention relates to a process for eliminating dust from fiber material guided over a sieve-like surface, and an apparatus for carrying out the process. The fiber material is exposed to a suction airstream guided through the sieve-like surface.

From the taker-in of a card, it is known to guide fiber material during its transport over a sieve-like surface surrounding the taker-in cylinder (see, for example, German Offenlegungsschrift No. 1,510,337). During the time when this fiber material is held in the effective range of the taker-in cylinder, it is further exposed to a suction airstream directed radially outwards. Dust resting loosely on the outside of the fiber material located in the clothing of the taker-in cylinder is thereby sucked off. However, there is the danger that remains of fiber, e.g., husk particles, etc. will stick to the sieve-like surface and clog it.

Fiber material is also guided according to known systems over sieve-like surfaces during dust removal in a blow room (see, for example German Patent Specification No. 3,304,571). Since the suction airstream acts transversely relative to the fiber transport direction, there is again the danger that remains of fiber, e.g., husk particles, etc., will cause clogging of the sieve-like surface.

There is also known a proposal to retain, in the form of a fiber tuft, the sliver fed to an opening cylinder of an open-end spinning apparatus while it is guided over the sieve-like surface surrounding the opening cylinder (see, for example, German Auslegeschrift No. 2,648,715). The advantage of this in comparison with cleaning in the region of the taker-in cylinder of a card is that highly intensive removal of the dust is achieved, since a sliver fed in is opened into individual fibers at this location. However, since the fiber tuft is still retained, as described above, the dust located between the fibers is scraped off by the clothing of the rotating opening cylinder. The dust removed from the fibers in this way is conveyed away by means of the suction air. Even in this known apparatus there is the danger that fiber remains, particles of dirt or the like will stick to the sieve-like surface and thereby reduce the efficiency of dust elimination.

One object of the present invention is, therefore, to provide a process and an apparatus for eliminating dust from fiber material, especially on open-end spinning machines, so that this danger of clogging the sieve-like surface does not exist or at least is considerably reduced (i.e., effectively eliminated if not literally so).

According to one aspect of this invention, a suction airstream, to which fiber material is exposed in the region of the sieve-like surface, is guided away from the fiber material at an acute angle in a sense opposite to the fiber transport direction. Because of the suction airstream orientation having a movement component directed opposite to the fiber transport direction, fly, fiber remains, husk particles, nips, etc., are prevented from becoming stuck in the sieve-like surface. Because of inertia, the fibers and dirt particles instead maintain their previous direction of flight along the wall containing the sieve-like surface. Only micro-dust particles, which because of their low mass are practically free of inertia and can therefore accomplish an immediate change in direction, follow the guided suction airstream through the sieve-like surface.

Particularly intensive cleaning is possible if fiber material is held in the range of influence of a clothing cylinder by a sieve-like surface while it is exposed to a suction airstream.

Cleaning of fiber material is further intensified if it is aligned in parallel before being exposed to a suction airstream. In such case, increased relative movement between the clothing and fiber material to be cleaned becomes possible. As a result, not only is dust which is located anywhere on the surface of or loosened from the fibers sucked off, but dust also scraped off from the fibers carrying it, so that even such dust can be removed by means of the suction airstream.

On open-end spinning machines, fiber material may be fed to a clothing cylinder in the form of a sliver including fibers aligned in parallel. The clothing cylinder may be an opening cylinder.

According to one feature of the present process while fiber material is exposed to a suction airstream it is also retained in the form of a fiber tuft in the nip of the supply device. The scraping-off effect is thereby further intensified and results in thorough cleaning of the fiber material. This is extremely important in open-end spinning, since the composite fiber structure is interrupted during spinning, and any dirt impairs the spinning process considerably.

To prevent light-weight material, such as fly, etc., from sticking to the sieve-like surface and thus possibly impairing the operating ability of the dust-eliminating device, according to a further feature of this invention an air jet is briefly directed onto a side of the sieve-like surface which faces away from the fiber transport path. This ensures that such constituents are lifted from the sieve-like surface, so that the dust-eliminating device can perform its function perfectly. At the same time, the cleaning interval for the sieve-like surface can be coordinated with the work process of the textile machine or apparatus on which the invention is used in such a way that this work process is not impaired.

According to an aspect of this invention in carrying out the process, the sieve orifices of the sieve-like surface are inclined at an acute angle counter (i.e., opposite) to the fiber transport direction. This ensures that the suction airstream acting on the side of sieve-like surface which is away from the fiber transport path can indeed draw off the dust loosened from fibers, but with no possibility of larger particles (such as dirt or fibers) becoming stuck in the sieve orifices as a result.

One preferred embodiment includes the sieve orifices formed as elongate holes which extend essentially transversely relative to the fiber transport direction.

According to another advantageous feature of this invention, the sieve-like surface may be arranged in the peripheral region of a clothing cylinder. To ensure that the suction airstream exerts a centering effect on the fiber/airstream, the sieve orifices formed as elongate holes are arranged at an acute angle to the transport direction that, from the perspective of the fiber transport direction, has their ends inclined towards an imaginary central-peripheral line of the clothing cylinder. This also ensures that light-weight fly picked up by air flowing through the sieve-like surface is oriented in the direction of these sieve orifices formed as elongate holes and thus passes through such sieve orifices. This reduces danger of clogging the sieve-like surface.

With sheet metal sieves, sieve orifices are usually made by stamping. However, it is not possible in this way to orient the sieve orifices relative to the direction of movement of the fiber/airstream in a desired manner. Nevertheless, so that a suction airstream oriented in the desired way can be generated simply, according to another feature of this invention, lamella (i.e., thin scales or plates) are formed in the sheet metal by means of a combined deep-drawing/stamping tool. These lamellae separate the elongate holes from one another and are inclined opposite to the fiber transport path in the fiber transport direction. It is not necessary to stamp material out of the sheet metal to form the elongate holes; instead, the inclined lamella can be formed by making a cut parallel to the desired direction of each elongate hole with the resulting subsequent plastic deformation of the sheet metal in front of this cut in relation to the fiber transport direction.

To make it possible to occasionally remove fly constituents, which despite the inventive inclination of the sieve orifices nevertheless might settle on the sieve-like surface, a blowing-air nozzle is directed onto a side of the sieve-like surface facing away from the fiber transport path. A device for generating a brief compressed-air jet is operatively associated with the nozzle.

A feature of this invention also includes measuring the dust content in fiber material. For this purpose, in a further embodiment in accordance with the invention, a widening dust-collecting chamber, having several filters in succession of increasing fineness, is arranged between the sieve-like surface and the suction-air source. Since the filters or sieves through which the dust-laden air first passes are coarser than the following filters or sieves, the finer fly and dust constituents are allowed to pass through the first sieve or filter and are intercepted only at the next filter or one of the following filters, thus ensuring that different waste constituents are separated. To make it possible to separate different types of dust, while also determining the exact ratio of the individual proportions of dust, dirt and good-quality fiber, according to this invention a dust-eliminating orifice (with which a widening dust-collecting chamber is associated), a dirt-eliminating orifice (with which a dirt-collecting chamber is associated), and a fiber discharge orifice (with which a fiber-collecting chamber is associated) are arranged in succession along the fiber transport direction and in the wall surrounding the clothing cylinder.

This invention makes it possible to remove dust from fiber material on a wide variety of textile machines and thereby avoids the danger of clogging a sieve surface retaining fiber material opposite to the effect of a suction airstream. Dust-elimination conditions which remain unchanged even over relatively long periods of time are consequently achieved on preparatory machines and cards, etc. On open-end spinning machines, which are highly sensitive to the incidence of dust, when a sieve surface formed in accordance with this invention is arranged in a peripheral wall surrounding the opening cylinder, in the region of fiber material still retained as a fiber tuft by the supply device, not only is clogging of the sieve-like surface prevented, but over long operating periods dust deposits are avoided in the collecting groove or at the open edge of the spinning rotor, thereby preventing thread breakages.

The above description shows that the clothing cylinder, in the effective range of which the sieve-like surface is located, can have various emobidments. Depending on the type of machine to which the invention is applied, a saw-tooth or porcupine roller (for example, in the opening device of an open-end spinning installation or in the taker-in of a card) or even an impeller (for example, in spinning preparation) can be used as a clothing cylinder.

BRIEF DESCRIPTION OF THE DRAWINGS

A full explanation of this invention is set forth in more detail in the following specification, with reference to the accompanying drawings, in which.

DETAILED DESCRIPTION OF THE PREFERRED EMBODIMENTS

Figure 1:
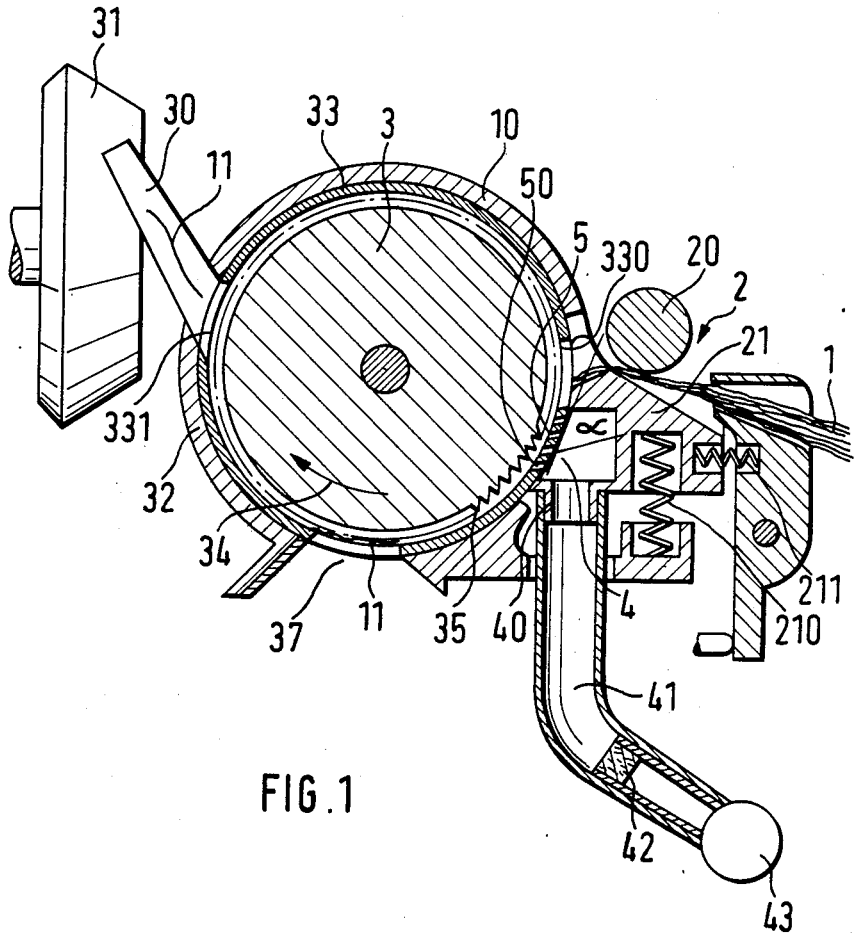
FIG. 1 illustrates, in section, an open-end spinning apparatus including fine-dust elimination features in accordance with this invention, and a conventional dirt-eliminating device.

FIG. 1 illustrates those parts of an open-end spinning apparatus which are necessary for an understanding of this invention. In such a spinning apparatus, sliver 1 to be spun is fed to an opening cylinder 3 by means of feed device 2. In the embodiment illustrated, feed device 2, which can in principle take differing forms, has delivery roller 20 and feed trough 21 interact:ng with the latter. The front end of sliver 1 constituting a fiber tuft 10 is opened up into individual fibers 11 by opening cylinder 3 and is supplied in this form to spinning element 31 through fiber feed channel 30. In the exemplary embodiment illustrated, this spinning element is designed as a spinning rotor, but the spinning element used can be one which also operates electrostatically, pneumatically, frictionally or in any other way. The fiber material is drawn off from spinning element 31 in the form of a thread in a known way (not shown).

Opening cylinder 3 is surrounded by housing 32 with wear-resistent lining 33 which possesses required orifices 330 (for supplying sliver 1 to opening cylinder 3) and 331 (for discharging fibers 11 into fiber feed channel 30).

Between supply device 2 and spinning element 31, there is in housing 32 a dust-eliminating orifice 4 which is covered by a sieve-like surface 5. Sieve-like cover 5 is an integral component of housing lining 33, feed trough 21 being supported on the side of the latter facing away from opening cylinder 3. For this purpose, two compression springs 210 and 211 are associated in a known way with feed trough 21.

The sieve-like surface 5 has sieve orifices 50 which are inclined at an acute angle $\alpha$ opposite (counter) to the fiber transport direction, illustrated by arrow 34. As shown in FIG. 1, the transport direction is always given by the tangent to the circle determined by clothing tips 35 of opening cylinder 3, at the vertex of the angle $\alpha$.

On feed trough 21 there is a pipe connector 40 which communicates with dust-eliminating orifice 4 and to which a hose-like channel 41 is connected. A suction air source 43 is connected to channel 41 via filter 42.

The fibers 11 are loosened from the front end of sliver 1 by the rotating opening cylinder 3 and are guided to the fiber feed channel 30 between the opening cylinder 3 and the inner wall of the housing 32 formed by lining 33, the fibers being held in the effective range of the clothing tips 35 of opening cylinder 3 by lining 33. From the fiber feed channel 30, fibers 11 thus pass inside spinning element 31 to be tied into the thread end.

On their way from the feed (supply) device 2 to fiber feed channel 30, fibers 11 are guided over sieve-like surface 5 which covers the dust-eliminating orifice 4. In the region of this sieve-like surface 5, the individual fibers 11 are exposed both to the effect of an air vortex (first airstream) rotating in the direction of the arrow 34 and to the effect of the airstream (second airstream) sucked into the dust-eliminating orifice 4 through the sieve orifices 50. This second airstream causes dust and fiber material to separate as a result of inertia. The fiber material is exposed to this second airstream in the region of the sieve-like surface 5. Because sieve orifices 50 are inclined at an acute angle $\alpha$ counter to the fiber transport direction (arrow 34), the second airstream is likewise oriented at this acute angle $\alpha$ relative to this fiber transport direction and is guided away from the fiber material in this direction.

Because of inertia and/or as a result of the meshing action of the clothing cylinders 35, individual fibers 11 are prevented from following this second airstream which is oriented at the acute angle $\alpha$ counter to the transport direction. Instead, they continue on their way to fiber feed channel 30.

However, the practically inertialess dust constituents, because of their small size, have a high air resistance and consequently a lower speed of vertical descent. They can therefore also remain in a gas-borne or airborne state for a longer time and be transported by the air of the second airstream movement. The dust particles thus follow the change in direction imposed by this airstream and pass through the sieve orifices 50 to filter 42 where they are intercepted. To maintain suction intensity over a long period of time, filter 42 may be occasionally replaced with a new one or cleaned.

Particularly intensive dust elimination is achieved when the dust is sucked out of the fiber material, as loosened from fibers 11, in the region of the fiber transport path. This may occur in the opening region where the fiber material is still retained as a fiber tuft 10 by the supply device 2. When sliver 1 is opened into individual fibers 11, dust on the surface of the fibers is rubbed off by several actions: as a result of the mechanical stress exerted by the fibers 11 on the clothing tips 35 of the opening cylinder 3; as a result of the friction of the fibers 11 against one another and against the guide surface; and as a result of the friction of the fibers 11 on the wall of the housing 32. As illustrated in FIG. 1, the dust-eliminating orifice 4 covered by the sieve-like surface 5 is therefore arranged in the region of fiber tuft 10.

Light-weight fly usually passes through the sieve orifices 50 without difficulty and is sucked off by the airstream sucked through the sieve orifices 50. It is nevertheless impossible over time to prevent a few short fibers and some fiber fly from sticking to the sieve orifices 50.

Figure 2:
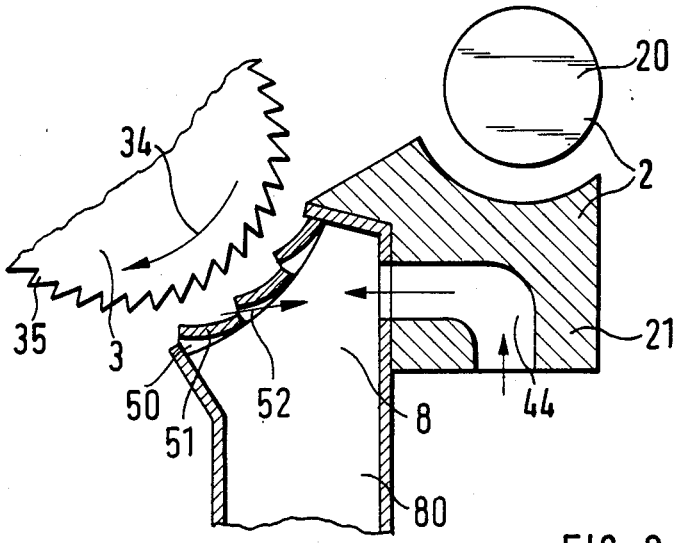
FIG. 2 illustrates, in section, a modification, in accordance with this invention, of a sieve-like surface.

To avoid impairing the efficiency of dust elimination, there is illustrated in feed trough 21 of FIG. 2 a blowing-air nozzle 44 which is pointed in the direction opposite to the flow of air through the sieve-like surface 5, towards a side of the surface 5 facing away from opening cylinder 3. A control device for generating a brief compressed-air jet is associated with the blowing-air nozzle 44. This control device may comprise, for example, a valve which briefly connects the blowing-air nozzle 44 to the compressed-air side of the suction-air source 43 which generates the vacuum in the dust-eliminating orifice 4.

The control device can be controlled in various ways in accordance with this invention to accomplish its purpose. Thus, it is possible for the control device to emit periodic control pulses for controlling a valve located in front of the blowing-air nozzle 44. However, it is also possible to assign a vacuum-measuring device to the dust-eliminating orifice 4. If the vacuum exceeds a predetermined tolereance range as a result of the partial covering of the sieve orifices 50, the compressed air is thereby released via the control device. It is, of course, also possible to provide manual control of a control valve for the blowing-air nozzle 44.

An air jet is briefly and intermittently directed by means of the blowing-air nozzle 44 onto the side of the sieve-like surface 5 facing away from the opening cylinder 3. This airstream oriented in the opposite direction to the air otherwise flowing through the sieve-like surface 5 consequently lifts off from surface 5 all the constituents possibly caught in the sieve orifices. The time during which the compressed-air jet acts is sufficiently short that it has practically no harmful effect on the fibers 11 supplied to the spinning element 31. However, if there is a danger of disturbances in the spinning process where specific materials are concerned, this sieve-cleaning operation can alternatively be carried out in accordance with this invention when the spinning station is not operating.

To also eliminate from the fiber/airstream heavy dirt constituents which usually have a larger mass and consequently also a greater inertia than the individual fibers 11, FIG. 1 illustrates a dirt-eliminating orifice 37 provided downstream from (along the fiber transport direction of arrow 34) the dust-eliminating orifice 4 in the housing wall surrounding opening cylinder 3.

Figure 3:
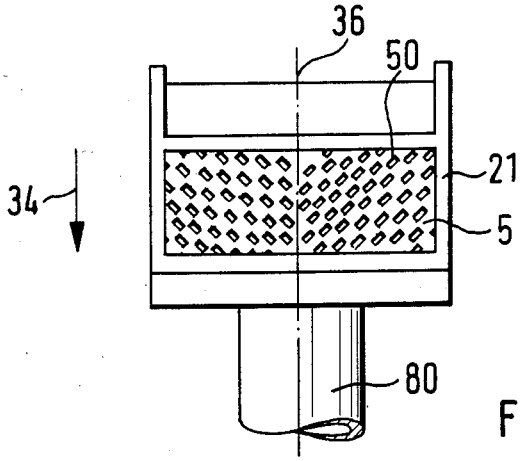
FIG. 3 illustrates a plan view of a sieve-like surface in accordance with this invention, from a side thereof facing the clothing cylinder.

FIG. 3 illustrates a feed trough 21 which both accomodates the dust-eliminating orifice 4 and carries the sieve-like surface 5 covering this dust-eliminating orifice. A hose-like channel 80 is connected to the feed trough 21.

In this exemplary embodiment, the sieve orifices 50 are formed as elongate holes which extend essentially transversely relative to the fiber transport direction (arrow 34). The sieve orifices 50 formed as elongate holes are not arranged at right angles to the fiber transport direction (arrow 34), as is also possible, but are inclined relative to this in such a way that, as seen from the perspective of the fiber transport direction, their ends approach an imaginary central-peripheral line 36. On one hand, this ensures an effect which centers the fiber/airstream rotating together with the clothing tips 35 of the opening cylinder 3. On the other hand, this formation of the elongate sieve orifices 50 ensures that even fly constituents and short fibers, which becuse of their low weight follow the air-stream sucked through the sieve-like surface 5, can pass through the sieve orifices 50 to the filter 42.

The sieve orifices 50 can be made in various ways, for example, by means of drilling or milling, etc. FIG. 2 illustrates a sieve-like surface 5, in which the sieve orifices 50 formed as elongate holes have been made by means of stamping and plastic deformation. Here, the edges limiting the sieve orifices 50 counter to the fiber transport direction (arrow 34) are formed by lamellae 51 which are inclined towards the opening cylinder 3 in the fiber transport direction. As indicated by arrow 52, such formation of the sieve-like surface 5 also produces an airstream which is oriented essentially opposite to the fiber transport direction identified by the arrow 34.

The better the dust elimination, the greater the degree of opening of the fiber material. Before the fiber material is supplied to the above-described open-end spinning apparatus, it is therefore aligned in parallel by means of drawing frames, etc., and fed to the opening cylinder 3 in the form of a sliver 1 with fibers aligned in parallel. Thus, fibers 11 loosened from sliver 1 are likewise in parallel before they are exposed to the airstream sucked through the sieve-like surface 5.

Although the elimination of dust from a fiber material opened up into individual fibers 11 in parallel is particularly intensive in accordance with this invention, it is nevertheless also possible to effectively eliminate dust from fiber material which is not aligned parallel and which is guided over a sieve-like surface in flock or mat form.

Figure 4:
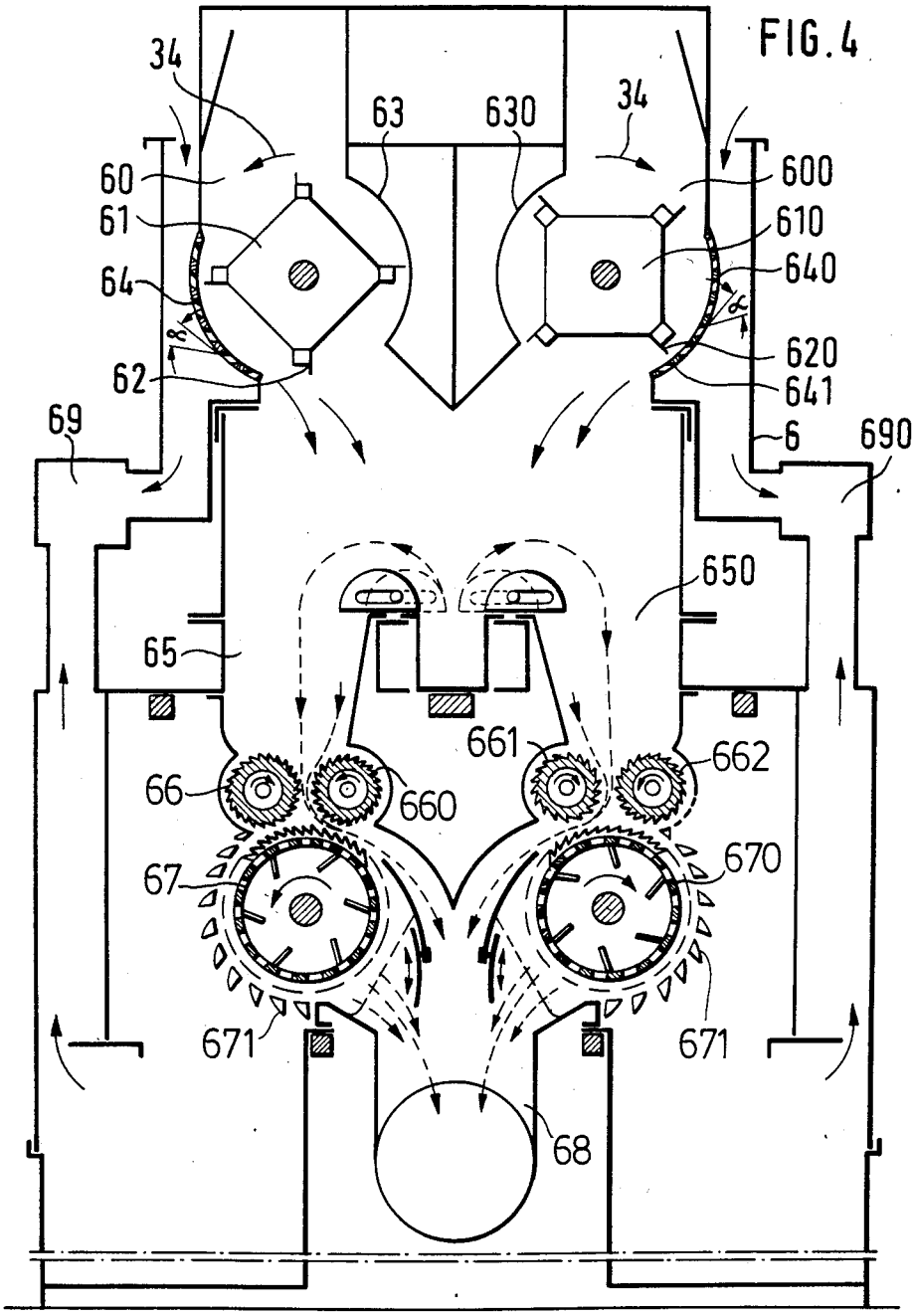
FIG. 4 illustrates, in section, a cleaning device in accordance with this invention and associated with a roving machine.

A first exemplary embodiment of this feature of this invention is described with reference to FIG. 4 which illustrates an apparatus for homogenizing, separating and cleaning fiber mixtures (German Offenlegungsschrift No. 2,217,394). A container 6, to which fiber material is supplied at its top, is formed of twin distributor shafts 60 and 600, each respectively having an impeller 61, 610 which is provided with sealing blades 62, 620 made of soft material, and which rotates in a housing 63, 630. Each housing 63, 630 has in its fiber guide region a wall comprising a sieve-like surface 64, 640. The sieve-like surface 64, 640 has sieve orifices 641 which are inclined at an acute angle opposite to the fiber transport direction identified by arrow 34.

Underneath the impellers 61 and 610 there are respective shafts 65 and 650, at the bottom ends of which are arranged cylinders, 66 and 660 or 661 and 662, which supply the fiber material to a drum 67, 670. To eliminate heavy dirt constituents, these in turn feed the fiber material via grate bars 671 to a channel 68, in which the fiber material is discharged and supplied to other machines pneumatically.

The impellers 61 and 610 rotating in the direction of the arrows 34 extract from the distributor shafts 60 and 600 the fiber material supplied pneumatically to them. At the same time, the transporting air is sucked off together with dust through sieve orifices 64 and 641, in which an airflow is obtained by means of suction-air-lines 69 and 690. Since the sieve orifices 64 and 641 are inclined at an acute angle $\alpha$ opposite to the fiber transport direction (arrow 34), here too, there is no danger of clogging the sieve-like surfaces 64 and 640.

Figure 5:
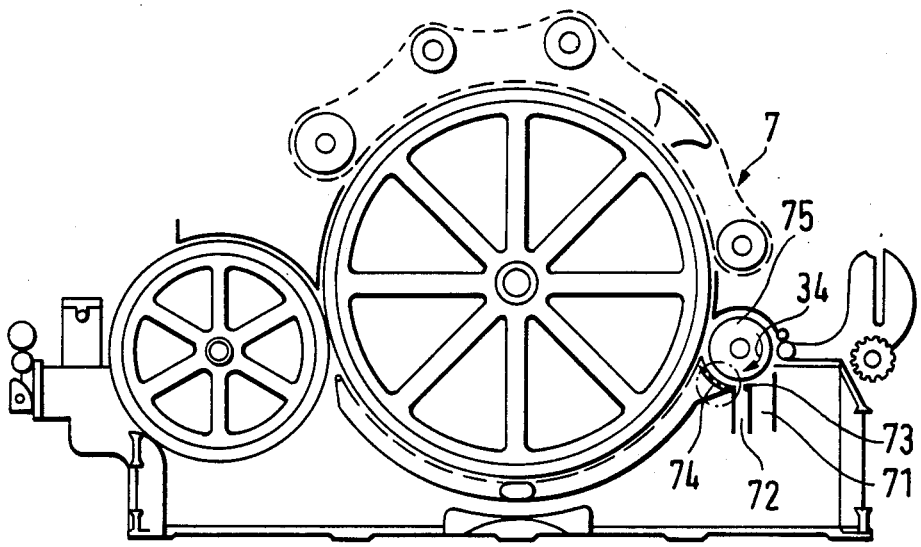
FIG. 5 illustrates a diagrammatic side view of a card in accordance with this invention.
Figure 5:
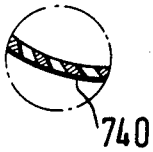

FIG. 5 illustrates that an implementation of a dust-eliminating device in accordance with this invention is also possible on cards 7. According to the exemplary embodiment illustrated, the wall surrounding taker-in cylinder 75 is interrupted in a fiber transport region. The dirt-eliminating orifices 71 and 72 formed thereby are each limited in the transport direction (arrow 34) by knife 73, by means of which coarse dirt is scraped off from the fiber material.

To eliminate fine dust which cannot be removed by means of knives 73 of this type, the last dirt-eliminating orifice 72 has adjacent to it a sieve-like surface 74 having sieve orifices 740 which, in the manner generally described above, are inclined at an acute angle $\alpha$ opposite to the fiber transport direction (arrow 34). Here again, dust is thus eliminated reliably, without danger of clogging sieve-like surface 74.

To increase operating reliability over even relatively long periods of operation, it is possible to provide here (as in the apparatus illustrated in FIG. 4) a compressed-air nozzle (not shown) which is directed onto sieve-like surface 74 (or 64 and 640) from a side facing away from taker-in cylinder 75 (the impellers 61 and 610), so that by means of a brief blast of compressed air, fly constituents caught on the sieve-like surface can be blown off.

Figure 6:
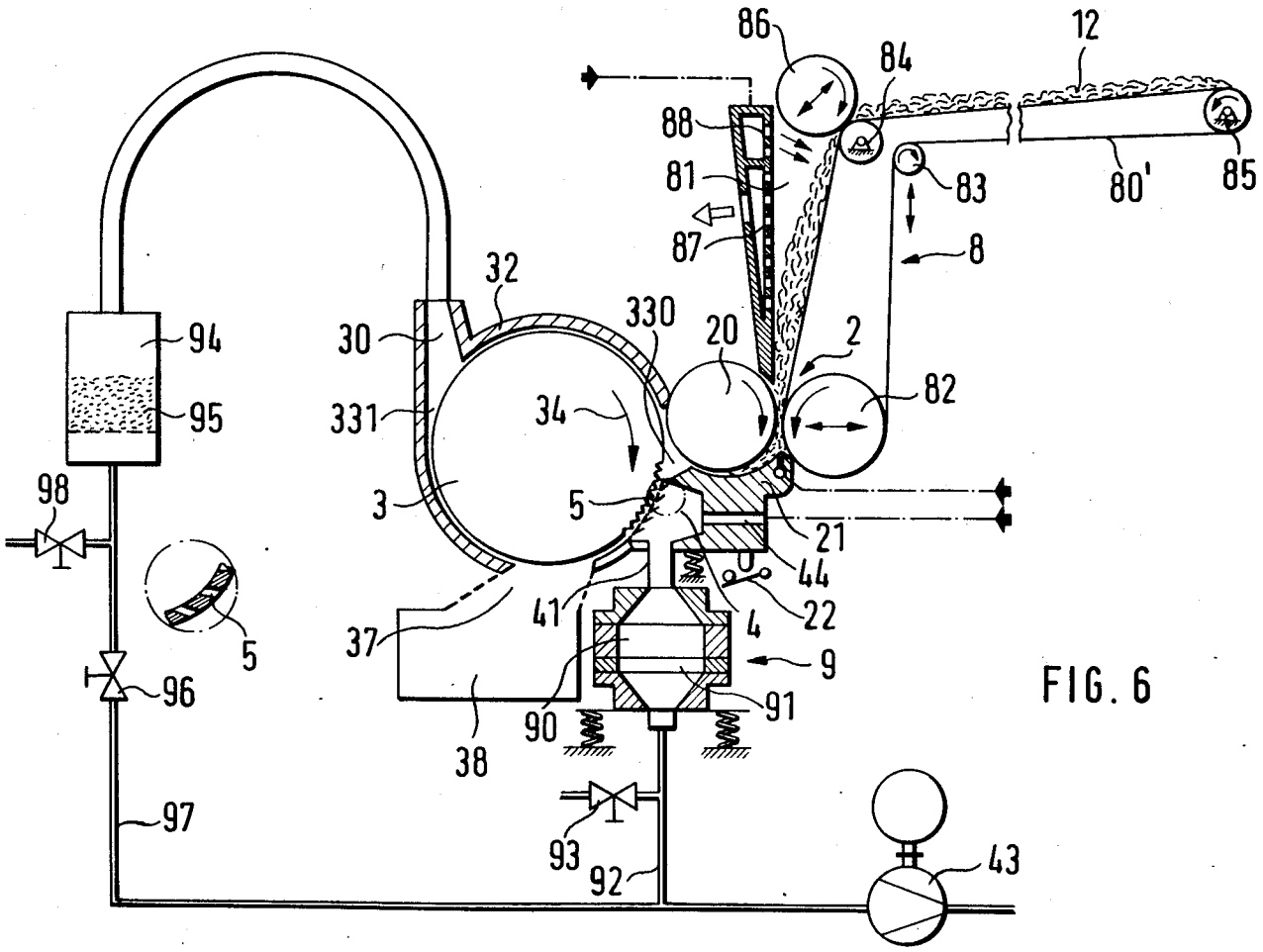
FIG. 6 shows diagrammatically a dust-measuring device in accordance with this invention.

To treat the fiber material carefully, in preparatory machines, cards, etc., fibers not yet aligned parallel are not subjected to such vigorous relative movement as in the opening device of an open-end spinning apparatus. Nevertheless, the dust and dirt content of fiber material can also be measured by means of a modification of the apparatus described with reference to FIGS. 1 to 3. Such a modified apparatus functioning as a dust and dirt-measuring device is illustrated in FIG. 6.

In such a device, there is a feeding arrangement 8 with a conveyor belt 80' which extends into a filling shaft 81 for fiber material 12. Drive roller 82 is provided at the lower end of filling shaft 81 for driving conveyor belt 80'. The conveyor belt 80' is deflected at the top end of filling shaft 81 by a deflecting roller 83 and a tenslon roller 84, in such a way that the conveyor belt extends essentially in a horizontal direction from deflecting roller 83 to a further deflecting roller 85. A compacting roller 86 interacts with the deflecting roller 83.

On the side located opposite conveyor belt 80', filling shaft 81 is limited by sieves 87, 88. Compressed air is supplied to filling shaft 81 through the upper sieve 88, while the lower sieve 87 serves to discharge spent air.

The feed trough 21 of supply device 2 has associated with it a limit switch 22 which stops the drive motor for drive roller 82 when the deflection of the feed trough 21 is too great, and which thus prevents further supply of fiber material 12 to opening cylinder 3. To do otherwise would make it impossible to measure the dust content of insufficiently opened fiber material 12 fed to the supply device 2 in the form of excessively large flocks.

Opening cylinder 3, dirt-eliminating orifice 37 and dust-eliminating orifice 4 together with sieve-like surface 5 are arranged in the manner described with reference to the illustrations of FIGS. 1 to 3. However, instead of a simple filter 42, as shown in FIG. 1, in this embodiment there is a filter unit 9 which has, in succession along the suction direction, a sieve 90 for short fibers and fly and a dust filter 91. Valve 93 connected to connecting line 92 between filter unit 9 and suction-air source 43 makes communication with the atmosphere when it opens, and thereby lowers the vacuum acting on dust-eliminating orifice 4.

A collecting container 38 is connected to the dirt-eliminating orifice 37.

The fiber feed channel 30 ends in a fiber-collecting vessel 94 which is connected to suction-air source 43 via a line 97, with a sieve 95 and a throttle 96 being interposed. Between the fiber-collecting vessel 94 and the throttle 96 there is a valve 98, by means of which it is possible to communicate with the atmosphere so that the strength of the vacuum effective in the fiber feed channel 30 can be controlled.

Appropriate synchronization of the vacuums in the dust-eliminating orifice 4 and in the fiber feed channel 30 by means of the valves 93 and 98 and the throttle 96 determines what proportion of short fibers is allowed to pass through the sieve-like surface 5 into the filter unit 9, the arrangement of the sieve orifices 50 at an acute angle $\alpha$ counter to the fiber transport direction (arrow 34) ensuring that larger individual fibers 11 do not settle on sieve-like surface 5 and block sieve orifices 50.

Operation of the FIG. 6 dust/dirt measuring device will now be explained.

The fiber material 12 to be checked is kneaded together into a uniform flock strip, the dimensions of which correspond to those of a sliver customary for open-end spinning machines. The fiber material 12 is fed to the opening cylinder 3 between the compacting roller 86 and deflecting (tensioner) roller 84, assisted by the airstream supplied through the sieve 87, and by means of the supply device 2. At the same time, the pneumatic compacting of the flock column in the filling shaft 81 guarantees a uniform supply of material to opening cylinder 3. However, should larger flocks be fed excessively to the supply device 2, the limit switch 22 actuated as a result of the pivoting of the feed trough 21 causes stopping of the drive roller 82, and consequently stops the supply of fiber to the opening cylinder 3.

Light-weight fly and dust are sucked off on sieve-like surface 5, while heavier dirt constituents are separated off at dirt-eliminating orifice 37 as a result of centrifugal force.

A perfect separation of short fibers and fly on the one hand and dust on the other hand is achieved by means of a suitable choice and succession of sieves and filters of increasing fineness (for example, of the sieve 90 and of the dust filter 91). When the cross-section through which the air flows in the filter unit 9 is widened in relation to channel 41 and connecting line 92 to form a widened dust-collection chamber, this ensures that the vacuum in the dust-eliminting orifice is not significantly impaired even after fly and dust have been deposited in this filter unit 9.

After the test operation has been carried out, the resulting quantities of dust (at the dust filter 91), short fibers (at the sieve 90), dirt particles (in the collecting container 38) and good-quality fibers (in the fiber-collecting vessel 94) can then be determined by physical measurement. This measurement can be conducted in various ways, including for example, electronically. For example, sensors for counting the fibers 11 and the coarse-dirt constituents may be provided in the region of the fiber feed channel 30 and the dirt-eliminating orifice 37. Instead of a dust filter, there may be in the filter unit 9 a piezoelectric quartz disk, on which the dust settles and thereby changes the frequency of the dust-laden quartz. The amount of dust per unit area can then be ascertained by comparison with a reference quartz (i.e., one protected from any dust contamination or environmental changes).

This apparatus can be modified, for example by changing the sieve-like surface according to FIGS. 2 or 3, or by choosing another type of fiber feed (another filling shaft or a feed in the form of a sliver composed of fibers aligned in parallel). To achieve the best possible measurement result, especially when feeding disorderd fibers (e.g., non-parallel arranged fibers), it is also possible to allow the fibers collected in the fiber-collecting container 94 to run through the dust-measuring device shown in FIG. 6 more than once.

It is also possible on the filling shaft 81 to provide the sieve 87 with sieve orifices which are oriented at an acute angle opposite to the fiber transport direction. In such a case, spent air is sucked through the filter unit 9 or a second filter unit of this type, so that the waste quantity occurring there can also be measured. In such an instance, the sieve-like surface is not arranged in a wall surrounding a cylinder, but dust elimination is still possible even without individual fibers loosening from their composite fiber structure in the form of a flock, lap sheet, mat or sliver and being sucked off through this sieve-like surface. This dust elimination is possible because the suction airstream is guided away from the fiber material towards the fiber transport path at an acute angle opposite to the fiber transport direction. The previously-described modifications of the sieve-like surface and the intermittently working compressed-air stream directed onto a side facing away from the fiber transport path may also be used with this presently-stated modification.

A sieve designed according to sieve 87 can also be used in filling shafts of other textile machines, for example cards.

All further modifications and variations of the present apparatus and method resulting from an interchange of features or their replacement by equivalents, and from combinations of such, which come within the skill of one of ordinary skill in the art all fall within the scope of the present invention, the scope of which is limited only by the appended claims. The exemplary embodiments described above are by way of example only, and their description is not intended as limiting to the scope of this invention.

What is claimed is:

1. A process for eliminating dust from fiber material, comprising the steps of:

guiding the fiber material in a defined fiber transport direction over a sieve-like surface having orifices inclined at an angle substantially parallel with the defined fiber transport direction;

exposing the fiber material to a suction airstream while it is guided over the orifice of the sieve-like surface; and guiding the suction airstream, to which the fiber material is exposed in the region of the sieve-like surface, through the sieve-like surface orifices so that such suction airstream travels in a direction away from the fiber material at an angle substantially opposite to the transport direction of the fiber material over the sieve-like surface, whereby the suction airstream removes dust from said fiber material without disturbing the transport direction thereof.

2. A process as in claim 1, further including the step of using the sieve-like surface to maintain the fiber material within the range of influence of a clothing cylinder during the time when the fiber material is exposed to the suction airstream.

3. A process as in claim 2, including the step of aligning the fiber material in parallel before the step of exposing it to the suction airstream.

4. A process as in claim 3, including the step of retaining the fiber material in the form of a fiber tuft while it is exposed to the suction airstream in the exposing step.

5. A process for eliminating dust from fiber material, comprising the steps of:

guiding the fiber material over a sieve-like surface;

exposing the fiber material to a suction airstream while it is guided over the sieve-like surface; and guiding the suction airstream, to which the fiber material is exposed in the region of the sieve-like surface, away from the fiber material at an acute angle opposite to the transport direction of the fiber material over the sieve-like surface, whereby the suction airstream removes dust from said fiber material without disturbing the transport direction thereof;

further including the step of controllably directing an airjet onto a side of the sieve-like surface, which side faces away from the fiber transport path as defined by the direction of fiber material transport, to dislodge any matter which might be present on the sieve-like surface and clogging same.

6. A fiber material handling apparatus, comprising:

rotatable opening cylinder means, having an input orifice for receiving into said cylinder means sliver-type fiber material which has at one point in time dust associated therewith and an output orifice for outputting from said cylinder means individual fibers of said fiber material, for separating said fiber material into individual fibers by its rotation;

a sieve-like surface, mounted within a portion of said cylinder means, and having orifices inclined at an acute angle so as to be generally tangent to the outside diameter of said cylinder means;

means for producing a first airstream having a pathway between said input orifice and said output orifice to draw said fiber material therealong, said pathway passing over said sieve-like surface; and means for producing a second airstream, said second airstream comprising a suction airstream which draws away from said sieve-like surface through said orifices thereof such that said second airstream is directed at an acute angle opposite to said pathway wherein said suction airstream draws dust from said fiber material without disturbing movement of said fiber material along said pathway thereof, and whereby said fiber material is separated from said dust for subsequent processing.

7. An apparatus as in claim 6, further comprising clothing tips within said cylinder means, and wherein said rotation of said cylinder means causes said clothing tips to act upon said fiber material while said fiber material is exposed to said suction airstream.

8. An apparatus as in claim 6, further including means for aligning said fiber material in parallel before it is exposed to said suction airstream.

9. An apparatus as in claim 8, including means for retaining said fiber material in the form of a fiber tuft while it is exposed to said suction airstream.

10. A fiber material handling apparatus, comprising:

rotatable opening cylinder means, having an input orifice for receiving into said cylinder means sliver-type fiber material which has at one point in time dust associated therewith and an output orifice for outputting from said cylinder means individual fibers of said fiber material, for separating said fiber material into individual fibers by its rotation;

a sieve-like surface, mounted within a portion of said cylinder means;

means for producing a first airstream having a pathway between said input orifice and said output orifice to draw said fiber material therealong, said pathway passing over said sieve-like surface; and means for producing a second airstream, said second airstream comprising a suction airstream which draws away from said sieve-like surface at an acute angle opposite to said pathway wherein said suction airstream draws dust from said fiber material without disturbing movement of said fiber material along said pathway, and whereby said fiber material is separated from said dust for subsequent processing;

further comprising airjet means for controllably directing an airjet onto a side of said sieve-like surface which faces away from said pathway, controlled airjets from said airjet means dislodging any matter which might be present on and tending to clog said sieve-like surface.

11. An apparatus as in claim 6, wherein said cylinder means has a dust-eliminating orifice for limiting said fiber transport pathway.

12. An apparatus as in claim 11, wherein said sieve-like surface orifices comprise elongate holes which extend essentially transversely relative to said fiber transport pathway.

13. An apparatus as in claim 6, wherein said sieve-like surface is mounted in an interior peripheral region of said cylinder means.

14. An apparatus as in claim 12, further comprising lamellae which separate said elongate holes from one another and are inclined at an angle counter to said fiber transport pathway.

15. An apparatus as in claim 6, further comprising a blowing-air nozzle directed onto a side of said sieve-like surface facing away from said fiber transport pathway and adapted for receiving the output of a device for generating a brief compressed-airjet, said nozzle directing said airject so as to dislodge any material tending to clog said sieve-like surface.

16. A fiber material handling apparatus, comprising:

rotatable opening cylinder means, having an input orifice for receiving into said cylinder means sliver-type type fiber material which has at one point in time dust associated therewith and an output orifice for outputting from said cylinder means individual fibers of said fiber material, for separating said fiber material into individual fibers by its rotation;

a sieve-like surface, mounted within a portion of said cylinder means;

means for producing a first airstream having a pathway between said input orifice and said output orifice to draw said fiber material therealong, said pathway passing over said sieve-like surface; and means for producing a second airstream, said second airstream comprising a suction airstream which draws away from said sieve-like surface at an acute angle opposite to said pathway wherein said suction airstream draws dust from said fiber material without disturbing movement of said fiber material along said pathway, and whereby said fiber material is separated from said dust for subsequent processing;

further including a source for said suction-airstream, and including between said sieve-like surface and said source of said suction-airstream a widening dust-collecting chamber, which chamber is associated with said dust-eliminating orifice and includes several filters arranged in succession of increasing fineness.

17. An apparatus as in claim 16 further comprising:

a dirt-eliminating orifice formed in said cylinder, downstream via said pathway from said dust-eliminating orifice and with which a dirt-collecting chamber is associated, and a fiber discharge orifice comprising said output orifice formed in said cylinder downstream via said pathway from said dirt-eliminating orifice and with which a fiber-collecting chamber is associated.

18. An apparatus as in claim 17, further including means for quantitatively measuring the contents of said dust-collecting chamber, said dirt-collecting chamber and said fiber-collecting chamber; and means for determining the ratio of dust and dirt to said fibers separated therefrom.

19. An apparatus as in claim 16, wherein said dust-collecting chamber includes therein a piezoelectric quartz disk, the oscillation frequency of which varies from a reference quartz oscillation frequency in accordance with the amount of dust settled thereon, thereby constituting a measuring device for the amount of dust received in said dust-collecting chamber.

20. An apparatus as in claim 6, further comprising drive means for supplying said sliver-type fiber material to said input orifice of said opening cylinder means, and limit switch means for suspending said supplying whenever deflections of said drive means exceed a predetermined amount.

21. A fiber material handling apparatus, comprising:

transport means for transporting fiber material in a predetermined transport direction;

a sieve-like surface disposed relatively adjacent and generally along at least a portion of said transport direction so that fiber material transported therealong passes over said sieve-like surface, said sieve-like surface including orifices inclined at an acute angle so as to be positioned generally tangential to said predetermined transport direction;

means for producing a first airstream having a pathway generally corresponding to said fiber material transport direction and passing over said sieve-like surface; and means for producing a second airstream comprising a suction airstream for drawing away from said sieve-like surface through said orifices thereof so that said second airstream is directed at an acute angle opposite to said first airstream pathway so as to draw dust from said fiber material without disturbing movement thereof along said pathway, whereby dust is separated from said fiber material for subsequent processing of such material.

22. An apparatus as in claim 21, further comprising:

a supplemental sieve-like surface arranged upstream, relative said fiber material transport direction, of said sieve-like surface through which said suction airstream is drawn; wherein said second airstream means also produces said suction airstream thereof relative said supplemental sieve-like surface, said supplemental sieve-like surface being disposed so as to permit a supply of compressed air to be introduced into said second airstream so produced relative said supplemental surface.

23. An apparatus as in claim 21, wherein said transport means includes a filling shaft for unorientated fiber material.

24. A process for separating and collecting dust and impurities from fiber material, comprising the steps of:

providing a housing having a circumferential inner surface and an input orifice and an output orifice;

providing a rotating opening cylinder within said housing for opening fiber material supplied thereto through said input orifice of said housing;

associating a fiber collecting chamber with said output orifice adapted for collecting opened fibers therein;

providing a dust separation orifice in said housing adjacent a fiber retention surface thereof and along said circumferential inner surface between said input and output orifices thereof;

associating a dust filter unit with said dust orifice adapted for collecting dust;

providing a dirt eliminating orifice along said circumferential inner surface of said housing downstream from said dust orifice;

associating a dirt collecting chamber with said dirt eliminating orifice adapted for collecting dirt constituents therein; and exposing said dust orifice to a suction air stream, while rotating said cylinder, so as to draw dust from said fiber material within said housing, through said dust orifice, and into said ddst filter unit without disturbing movement of said fiber material within said housing, such cylinder rotation causing centrifugal force which separates dirt constituents from fiber material within said housing and passes same through said dirt eliminating orifice and into said dirt collecting chamber, with inertia of said fiber materials continuing same to said housing output orifice;

whereby dust, dirt, and opened fibers are separated and respectively collected in said dust filter unit, said dirt collecting chamber, and said fiber collecting chamber.

25. A process as in claim 24, wherein said dust filter unit includes at least two successive filters of progressive fineness so as to separate said dust into fine dust and short fibers with flyweight constituents.

26. A process as in claim 24, including the step of exposing said housing output orifice to a suction air stream so as to direct said opened fibers into said fiber collecting chamber.

27. A process as in claim 26, including the step of varying the degree of separation of dirt constituents from said fiber material during rotation of said cylinder by adjusting the force of the suction air stream to which said housing output orifice is exposed.

28. An apparatus for handling fiber material and separating respectively dust and dirt therefrom, comprising:

a housing having a circumferential inner surface and a fiber feed point and a fiber outlet point;

a rotatable opening cylinder generally enclosed in said housing, for opening fiber material supplied thereto;

a sieve-like surface mounted within said housing;

a dust eliminating orifice, defined in the periphery of said housing downstream from said fiber feed point thereof, add covered by said sieve-like surface;

a dust filter chamber operatively associated with said dust orifice;

a suction air source;

means for directing suction from said housing through said dust orifice and said dust chamber to said suction air source, whereby dust is separated from fiber material within said housing and drawn through such suction directing means to be retained in said dust filter chamber;

a fiber collecting chamber connected via said fiber outlet point with said housing for collecting fibers leaving said housing; and a dirt eliminating orifice, defined in the periphery of said housing sufficiently downstream from said dust orifice such that centrifugal force generated by rotation of said cylinder causes dirt constituents to be separated from: fiber material in said housing, and exit therefrom through said dirt eliminating orifice and into a dirt collecting chamber associated with such dirt orifice; whereby dust and dirt are separated from: said fiber material within said housing, and collected in respective chambers therefore.

29. An apparatus as in claim 28, wherein said dust filter chamber includes at least two successive filters of increasing fineness.

30. An apparatus as in claim 28, wherein the cross-section of said dust filter chamber is generally wider than said suction directing means.

31. An apparatus as in claim 28, wherein said dust filter chamber includes a vibrating disk, the vibration frequency of which varies from a reference frequency in dependence with the amount of dust deposited thereon, whereby the amount of dust separated into said dust filter chamber from said fiber material may be

32. An apparatus as in claim 28, further comprising:

a feeding device for forwarding fiber material to said fiber feed point of said housing;

a sieve-like sidewall formed in said feeding device; and means for conducting suction from said feeding device through said sieve-like sidewall and said dust filter chamber, to said suction air source, whereby dust from fiber material within said feeding device may be separated and directed to said dust filter chamber.

33. An apparatus as in claim 29, further comprising means for directing suction from said housing through said fiber outlet point and said fiber collecting chamber to a suction air source, whereby opened fibers with dust and dirt separated therefrom are directed from said housing to said fiber collecting chamber.

34. An apparatus as in claim 33, wherein said fiber collecting chamber comprises a spinning rotor.

35. An apparatus as in claim 33, wherein said means for directing suction includes means for separatively varying the amount of suction directed to both said dust eliminating orifice and said fiber outlet point.

36. An apparatus as in claim 20, wherein said drive means includes a drive roller and an associated pivotably supported feeding trough, with said fiber material passing therebetween and deflecting said pivotable feeding trough into a switch for suspending drive power to said drive roller whenever the fiber material thickness between such elements exceeds a predetermined amount.

* * * * *